US008881824B2

(12) United States Patent
Stautzenberger

(10) Patent No.: US 8,881,824 B2
(45) Date of Patent: Nov. 11, 2014

(54) MECHANICALLY ACTUATED DEVICE POSITIONED BELOW MECHANICALLY ACTUATED RELEASE ASSEMBLY UTILIZING J-SLOT DEVICE

(71) Applicant: Halliburton Energy Services, Inc., Houston, TX (US)

(72) Inventor: Arthur Stautzenberger, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/883,635

(22) PCT Filed: Oct. 26, 2012

(86) PCT No.: PCT/US2012/062097
§ 371 (c)(1), (2), (4) Date: May 6, 2013

(87) PCT Pub. No.: WO2014/065814
PCT Pub. Date: May 1, 2014

(65) Prior Publication Data

US 2014/0124220 A1 May 8, 2014

(51) Int. Cl.

| | |
|---|---|
| ***E21B 43/10*** | (2006.01) |
| ***E21B 23/00*** | (2006.01) |
| ***E21B 17/06*** | (2006.01) |
| ***E21B 34/12*** | (2006.01) |
| ***E21B 43/00*** | (2006.01) |
| *E21B 34/00* | (2006.01) |

(52) U.S. Cl.
CPC ..... *E21B 43/00* (2013.01); *E21B 2034/005* (2013.01); *E21B 23/006* (2013.01); *E21B 17/06* (2013.01); *E21B 43/10* (2013.01); *E21B 34/12* (2013.01)
USPC ..... 166/334.1; 166/331

(58) Field of Classification Search
CPC ..... E21B 23/006; E21B 34/12; E21B 43/10; E21B 23/00
USPC ..... 166/334.1, 381, 382, 205, 206, 331
See application file for complete search history.

(56) References Cited

U.S. PATENT DOCUMENTS 3,279,539 A * 10/1966 Brown et al. ..... 166/290
3,494,419 A * 2/1970 Mullins ..... 166/150

(Continued)

OTHER PUBLICATIONS

Written Opinion dated Apr. 23, 2013 for PCT Application No. PCT/US2012/062097.

(Continued)

*Primary Examiner* — Blake Michener
*Assistant Examiner* — Kipp Wallace
(74) *Attorney, Agent, or Firm* — Scott Richardson; Booth Albanesi Schroeder LLC

(57) ABSTRACT

A tool string carrying an external tool, such as a liner hanger, on a release mechanism is lowered into the wellbore. Interlocking lugs and J-slot profile, defined between the exterior surface of the mandrel and interior surface of the release mechanism, allow relative movement of release mechanism and mandrel without releasing the release mechanism. The relative movement allows mechanical operation of a valve or other tool positioned below the release mechanism. Weight-down and rotation of the tool string and mandrel actuates the lower valve assembly by turning a sleeve into alignment with cooperating members of the mandrel. The sleeve, no longer constrained, moves longitudinally in response to a biasing mechanism. Movement of the sleeve allows closure of the valve. After actuation of the valve tool, further weight-down releases the release mechanism from the carried tool.

15 Claims, 18 Drawing Sheets

(56) References Cited

U.S. PATENT DOCUMENTS

| | | | | | |
|---|---|---|---|---|---|
| 3,987,854 | A | * | 10/1976 | Callihan et al. | 166/278 |
| 4,105,069 | A | * | 8/1978 | Baker | 166/51 |
| 4,440,218 | A | * | 4/1984 | Farley | 166/51 |
| 4,572,290 | A | | 2/1986 | Clifton | |
| 4,603,743 | A | | 8/1986 | Lindsey, Jr. | |
| 5,082,062 | A | * | 1/1992 | Wood et al. | 166/382 |
| 5,857,524 | A | | 1/1999 | Harris et al. | |
| 6,227,298 | B1 | * | 5/2001 | Patel | 166/321 |
| 6,464,006 | B2 | * | 10/2002 | Womble | 166/276 |
| 7,431,094 | B2 | | 10/2008 | De Clute-Melancon | |
| 8,141,634 | B2 | | 3/2012 | Fisher et al. | |

OTHER PUBLICATIONS

International Search Report dated Apr. 23, 2013 for PCT Application No. PCT/US2012/062097.

* cited by examiner

MECHANICALLY ACTUATED DEVICE POSITIONED BELOW MECHANICALLY ACTUATED RELEASE ASSEMBLY UTILIZING J-SLOT DEVICE

CROSS-REFERENCE TO RELATED APPLICATIONS

None.

FIELD OF INVENTION

Methods and apparatus are presented for providing multiple relative positions between a release assembly on a tool string, thus allowing actuation of a mechanically operated tool positioned below the release assembly. More particularly, methods and apparatus are presented for sequential actuation of a mechanically operated tool positioned below a mechanically operated release mechanism, where the mechanically operated tool is positioned below the release assembly.

BACKGROUND OF INVENTION

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs).

In order to produce hydrocarbons, a wellbore is drilled through a hydrocarbon-bearing zone in a reservoir. In a cased-hole wellbore or portion thereof, a casing is placed, and typically cemented, into the wellbore providing a tubular wall between the zone and the interior of the cased wellbore. A tubing string can then be run in and out of the casing. Similarly, tubing string can be run in an uncased wellbore or section of wellbore. As used herein, "tubing string" refers to a series of connected pipe sections, joints, screens, blanks, cross-over tools, downhole tools and the like, inserted into a wellbore, whether used for drilling, work-over, production, injection, completion, or other processes. Further, in many cases a tool can be run on a wireline or coiled tubing instead of a tubing string, as those of skill in the art will recognize. A wellbore can be or include vertical, deviated, and horizontal portions, and can be straight, curved, or branched.

During completion of an open-hole wellbore portion, a completion tubing string is placed into the wellbore. The tubing string allows fluids to be introduced into, or flowed from, a remote portion of the wellbore. A tubing string is created by joining multiple sections of pipe together, typically via male right-handed threads at the bottom of an upper section of pipe and corresponding female threads at the top of a lower section of pipe. The two sections of pipe are connected to each other by applying a right-hand torque to the upper section of pipe while the lower section of pipe remains relatively stationary. The joined sections of pipe are then lowered into the wellbore. The process is referred to as "making up" and "running in" a string.

It is typical in hydrocarbon wells to actuate a downhole tool by relative longitudinal or rotational motion between tool parts caused by physical manipulation of the tool string, such as by placing weight down, lifting up, or rotating the string. Such actions are considered "mechanically operated" actuations, as opposed to electrically, hydraulically, or chemically operated. Mechanically operable tools can include release assemblies such as collet assemblies, expansion tools, packers, plugs, hangers, etc. Actuation can be used to "set" tools, release tools, open or close valves, etc. Other operations can be performed by the tool string as well. For example, a tubing string is run into a wellbore to hang an expandable liner and liner string, cement around the liner, expand the liner hanger, and release or disconnect the hung liner from the tool string. The string is then retrieved to the surface.

There is a need for tool assemblies, such as valves and release mechanisms, which can be mechanically operated. For example, a ball-drop actuated valve may not be operable or efficient in a horizontal bore at low tubing pressures.

SUMMARY OF THE INVENTION

A tool string carrying an external tool, such as a liner hanger, on a release mechanism is lowered into the wellbore. Interlocking lugs and J-slot profile, defined between the exterior surface of the mandrel and interior surface of the release mechanism, allow relative movement of release mechanism and mandrel without releasing the release mechanism. The relative movement allows mechanical operation of a valve or other tool positioned below the release mechanism. Weight-down and rotation of the tool string and mandrel actuates the lower valve assembly by turning a sleeve into alignment with cooperating members of the mandrel. The sleeve, no longer constrained, moves longitudinally in response to a biasing mechanism. Movement of the sleeve allows closure of the valve. After actuation of the valve tool, further weight-down releases the release mechanism from the carried tool.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which:

FIG. 2D is a longitudinal cross-section of the collet prop sleeve lugs and mandrel J-slot groove taken along line D-D of FIG. 2A, and FIG. 2E is a longitudinal cross-section of the collet prop sleeve lugs and mandrel J-slot groove taken along line E-E of FIG. 2B;

Figure 1A:
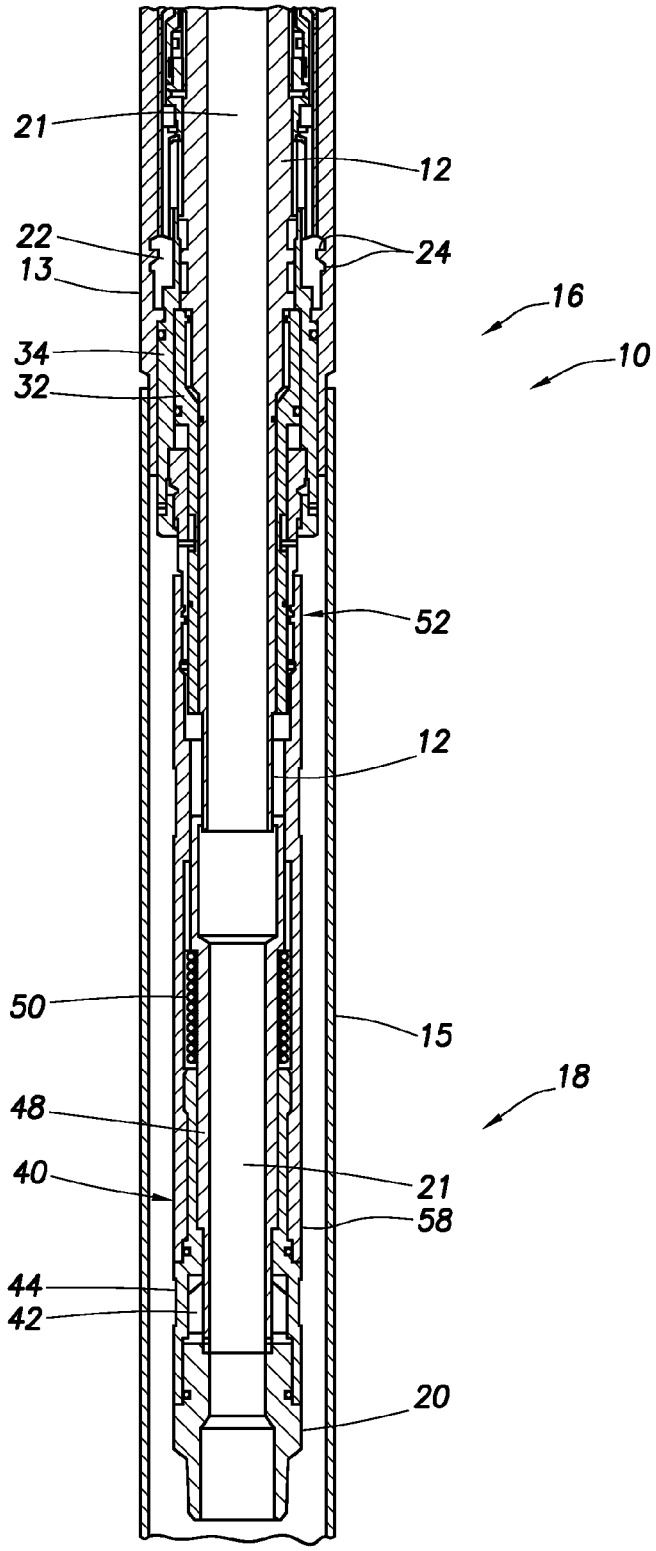
FIGS. 1A-C are schematic views of a partial liner hanger tool string including features according to aspects of the invention with FIG. 1A being a general schematic view, in cross-section, FIG. 1B a detail cross-section view of FIG. 1A, and FIG. 1C a detail cross-section of FIG. 1A.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The description is provided with reference to a vertical wellbore; however, the inventions disclosed herein can be used in horizontal, vertical or deviated wellbores. As used herein, the words "comprise," "have," "include," and all grammatical variations thereof are each intended to have an open, non-limiting meaning that does not exclude additional elements or steps. It should be understood that, as used herein, "first," "second," "third," etc., are arbitrarily assigned, merely differentiate between two or more items, and do not indicate sequence. Furthermore, the use of the term "first" does not require a "second," etc. The terms "uphole," "downhole," and the like, refer to movement or direction closer and farther, respectively, from the wellhead, irrespective of whether used in reference to a vertical, horizontal or deviated borehole. The terms "upstream" and "downstream" refer to the relative position or direction in relation to fluid flow, again irrespective of the borehole orientation. Although the description may focus on a particular means for positioning tools in the wellbore, such as a tubing string, coiled tubing, or wireline, those of skill in the art will recognize where alternate means can be utilized. As used herein, "upward" and "downward" and the like are used to indicate relative position of parts, or relative direction or movement, typically in regard to the orientation of the Figures, and does not exclude similar relative position, direction or movement where the orientation in-use differs from the orientation in the Figures.

The embodiment discussed is an expandable liner hanger tool string with the novel features providing for mechanical actuation of a valve positioned below a mechanically operated release mechanism, namely, a collet assembly. The invention is not so limited. Persons of skill in the art will recognize the usefulness of the invention and its teachings for use in operation of two mechanically actuated assemblies in sequence.

Standard liner hanger running tools allow use of a mechanically actuated sealing or valve assembly positioned at the top of the tool, which can be mechanically operated to divert pressure through a crossover body to the pistons for expansion. Since the valve mechanism can be located at the top of the tool, rotation and downward movement of the string used to actuate a mechanism, such as a J-Slot flapper valve, can easily be built into the tool. Standard tools can be efficiently used in vertical, horizontal and deviated wells. Further, ball-drop valves are effective in high pressure tools, even where the bore is horizontal. Low pressure tools, however, require a valve mechanism positioned below the collet release mechanism. This has prevented use of mechanically actuated valve mechanisms because the members of the collet release mechanism are generally rigidly connected, longitudinally and rotationally, to the liner hanger and tool mandrel, eliminating the possibility of mechanical actuation of a below-collet valve (or any other mechanically operated tool).

The invention allows a J-Slot profile to be designed into the collet mechanism, thereby allowing enough relative movement to operate a J-slot feature without un-propping the collet mechanism from the liner hanger. Having the J-slot located within the collet mechanism allows a flapper or other type of valve, or other tool, to be located at the bottom of the tool, below the collet mechanism. The purpose of the below-collet J-slot actuated mechanism is to provide a J-slot feature that will work below a collet mechanism that can be used to actuate a flapper, valve, or other tool device. The location of the J-slot below the collet mechanism provides a mechanically actuated setting option for low pressure liner hanger running tools which require a sealing mechanism located below the collet feature.

A J-slot profile is located in the collet mechanism. In this design, the location of the J-slot profile allows relative longitudinal movement and rotation of the inner mandrel without un-propping the collets and releasing the collet assembly. The rotation of the inner mandrel using the J-slot is used to turn a sleeve. When the sleeve is rotated, it lines up cooperating ridges and grooves, allowing it to move upwards in response to a biasing mechanism such as a spring. When the sleeve is moved upwards, a spring-loaded flapper valve closes, sealing the interior passageway of the tool, and a hydraulically actuated tool, such as an expansion assembly or slip assembly, can be set by building hydraulic pressure in the tool string against the now-closed valve. In the preferred embodiment, the valve assembly is a flapper valve, however, other mechanically operated valve types can be used, such as ball valves, gate valves, plunger valves, etc. Further the preferred embodiment uses relative rotational motion of the mandrel to allow relative longitudinal motion of an actuator sleeve. The rotational and longitudinal motions can be reversed or used in multiple sequences, as those of skill in the art will appreciate. This invention allows the use of a mechanism to achieve relative movement in an otherwise rigid connection. The movement can be used to activate a wide range of mechanisms.

Figure 1B:
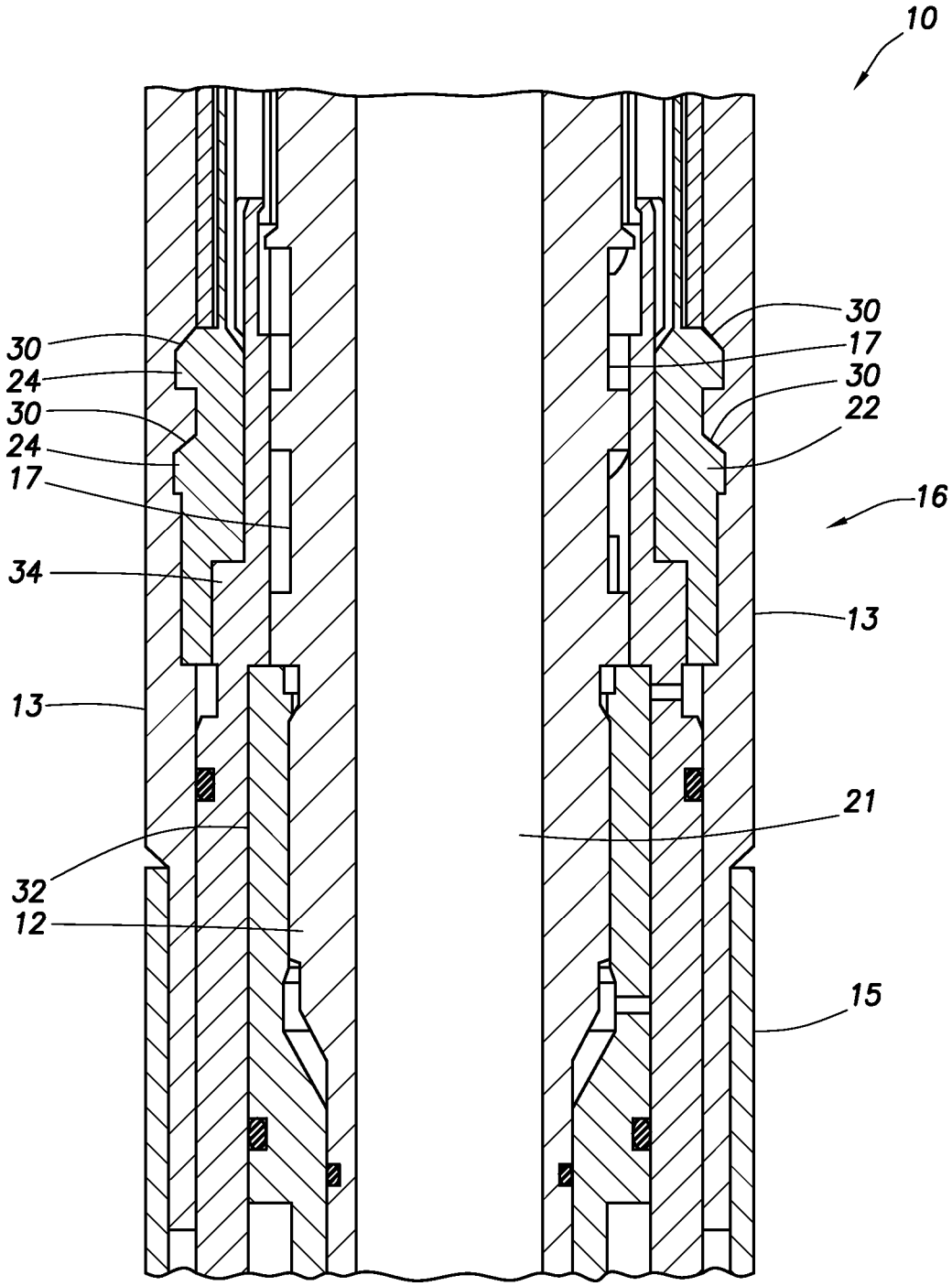
Figure 1C:
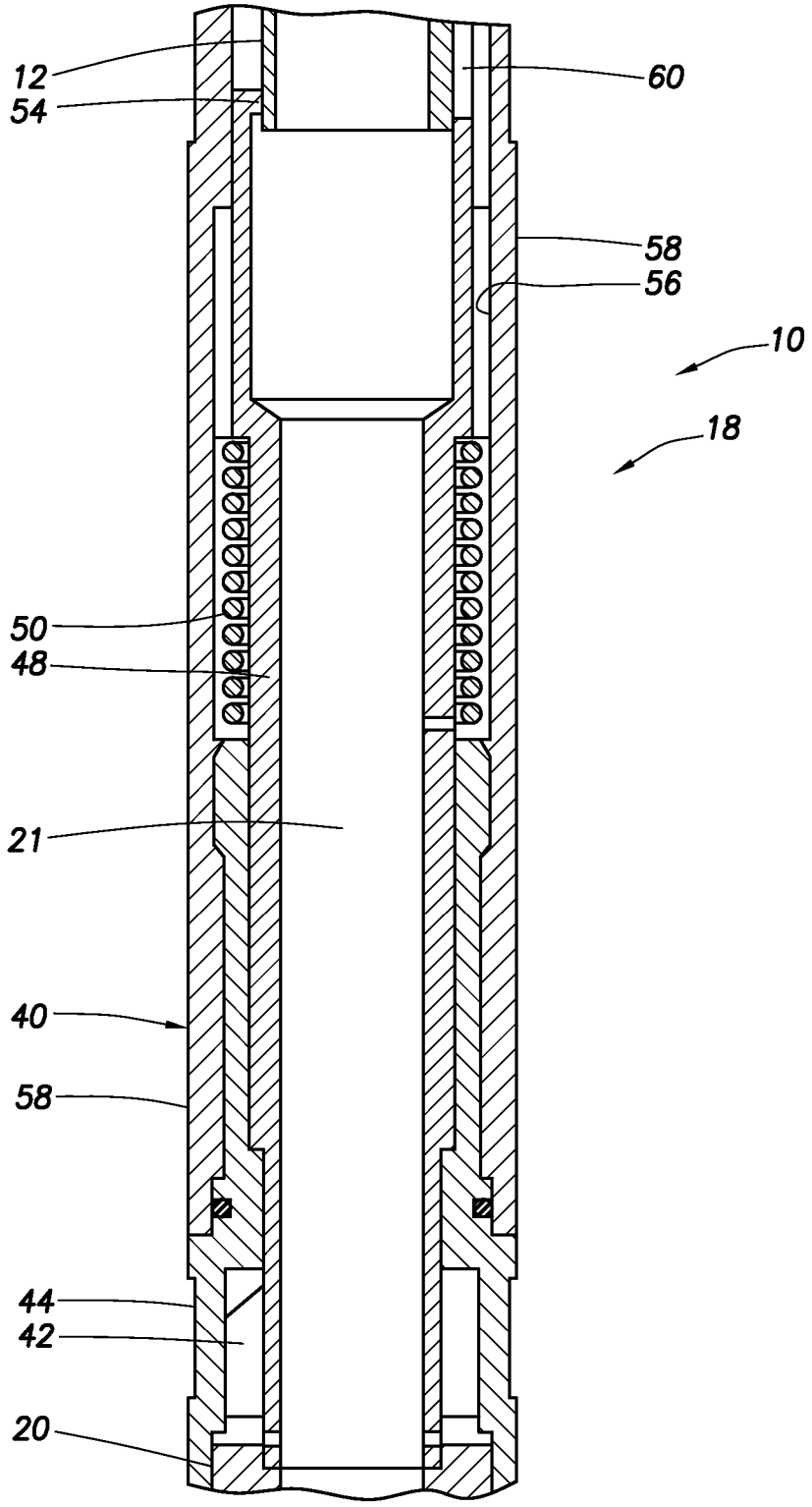

FIGS. 1A-C are schematic views of a partial liner hanger tool string including features according to aspects of the invention. These Figures provide a general overview for reference with more detailed discussion and figures to follow. FIG. 1A is a general schematic view, in cross-section, of an exemplary downhole tool string according to an aspect of the invention. FIG. 1B is a detail, cross-section view of FIG. 1A. FIG. 1C is a detail cross-section of FIG. 1A. Generally, the downhole tool string is shown as a liner hanger tool string 10. The tool string has a mandrel assembly 12, a liner hanger 13 from which hangs a liner string 15, a mechanically operated upper mechanism 16 and a mechanically actuated lower mechanism 18. The mechanically operated or actuated mechanisms can be various mechanically operated tools, such as valves, collets, sliding sleeves, port closure assemblies, etc., and perform various functions, such as fluid flow control, setting or actuating tools, releasing assemblies, etc., as are known in the art. The discussion herein is primarily limited to a liner hanger string with a bottom valve and release collet, but the invention is not so limited.

The tool assembly has a bottom sub or valve seat sub 20 at its lower end. The tool defines an inner passageway 21 extending along the tool string. The passageway 21 is used for delivery of fluids, such as cement, treatment fluid, fracturing fluid, etc. downhole and into the formation or wellbore. Similarly, the passageway can be used to allow or pump fluids upward towards the surface. The tool string extends from the upper end of the tool assembly shown, as is known in the art, and is made up of tubing sections, cross-over tools, etc., as also known in the art. The passageway 21 also serves as a pressure vessel, allowing for pressuring up or down in the tool string passageway in relation to pressures in the wellbore. The passageway also allows differential pressure across any valves positioned in the passageway. For example, where the mechanically actuated lower mechanism 18 is a valve assembly, tubing pressure is used to hydraulically actuate pistons and the like to expand a liner hanger, set a packer, etc.

The upper mechanically operated mechanism 16 is a release assembly, namely, a collet release assembly. The collet release assembly 16 releasably attaches the mandrel 12, via collet assembly 22, to a liner hanger, where collet lugs 24 cooperate with corresponding recesses defined on the interior surface of the liner hanger. The collet assembly is longitudinally and rotationally locked with respect to the liner hanger in the run-in position. The collet lugs provide load-bearing surfaces 30 which bear the tensile load in response to the weight of the liner hanger and attached liner. The liner hanger has corresponding opposed load-bearing surfaces. The collet prop nut 32 and prop sleeve 34 maintain the collet in its initial position with respect to the liner hanger 13 until moved or actuated to release the tool. A J-slot profile 17 is defined on the exterior surface of the mandrel 12 for interaction with corresponding protrusions on the interior of the prop sleeve 34. The J-slot is used to allow a first movement between the mandrel and collet assembly to actuate the lower mechanically operated tool 18. Such operation is performed, in a preferred embodiment, by placing weight down on the string and rotating the string a quarter turn, preferably a left-hand turn. A second actuating movement of the string operates the collet release assembly and allows pulling out of hole of the string, leaving the liner hanger in place.

The lower mechanically operated assembly 18 is shown as a valve assembly 40, here, a flapper valve assembly. The valve assembly includes a valve seat sub 20 and a compression spring nut 44 as shown. The valve element 42 is biased by a spring towards a closed position and maintained initially in an open position, as shown, by valve prop sleeve 48. The prop sleeve is biased by spring 50 upward. The prop sleeve 48 is held in an initial position, as shown, by cooperation of external prop ridges 54 on the prop sleeve which cooperate with inner grooves 56 on the valve assembly housing 58. The prop sleeve is rotationally operated by external grooves on the end of the mandrel 12 that engage protrusion extending from the interior of the prop sleeve 48. Adjustment sleeve assembly 52 connects the lower and upper mechanically operated mechanisms.

Figure 2A:
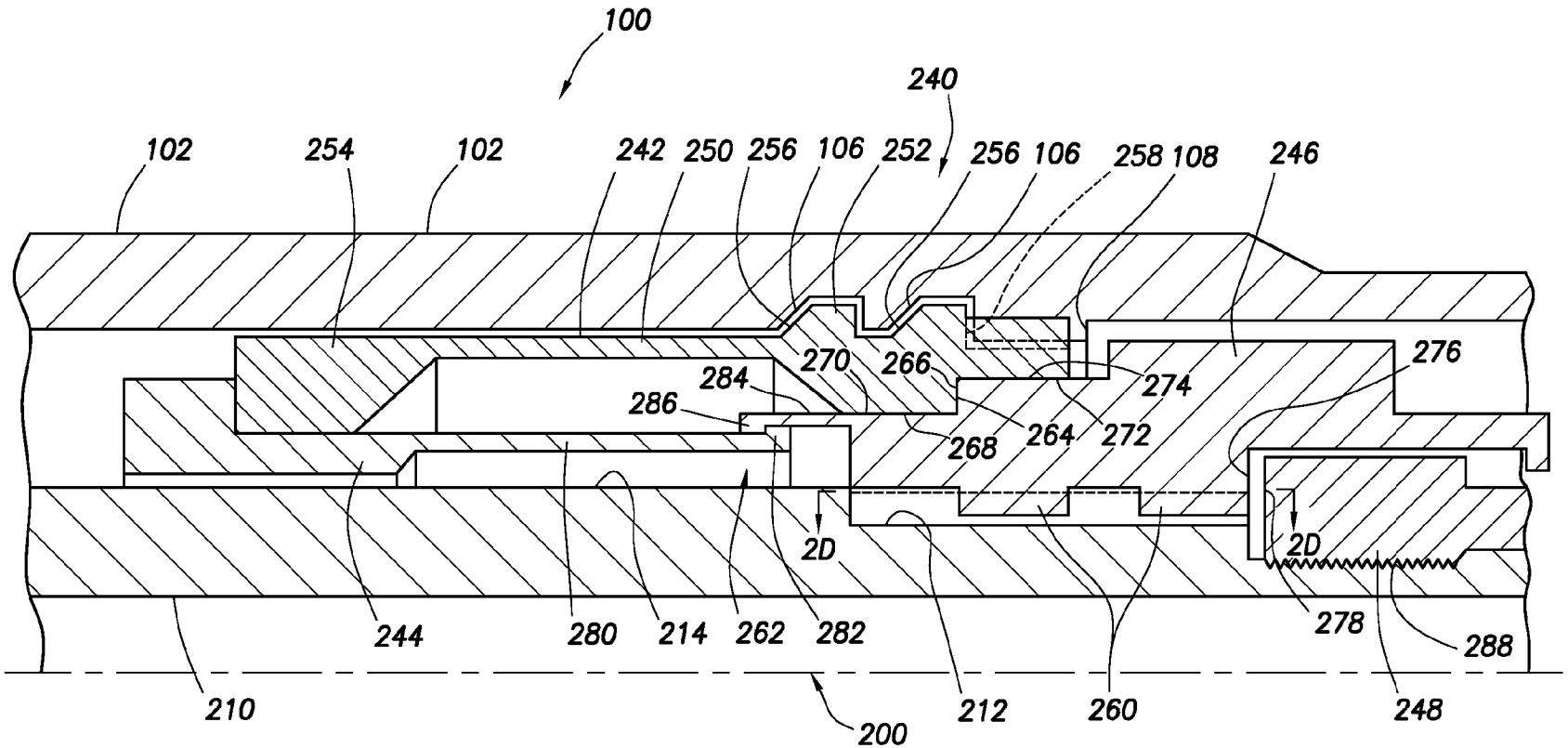
FIGS. 2A-E are cross-sectional, partial, schematic views of an embodiment of the J-slot and collet release features according to an aspect of the invention with FIG. 2A showing the tool assembly in a run-in position under tensile load, FIG. 2B showing the tool assembly in a weight-down and rotated mandrel position wherein the J-slot is engaged, FIG. 2C showing the tool assembly in a weight-down position wherein the release assembly is actuated.
Figure 2B:
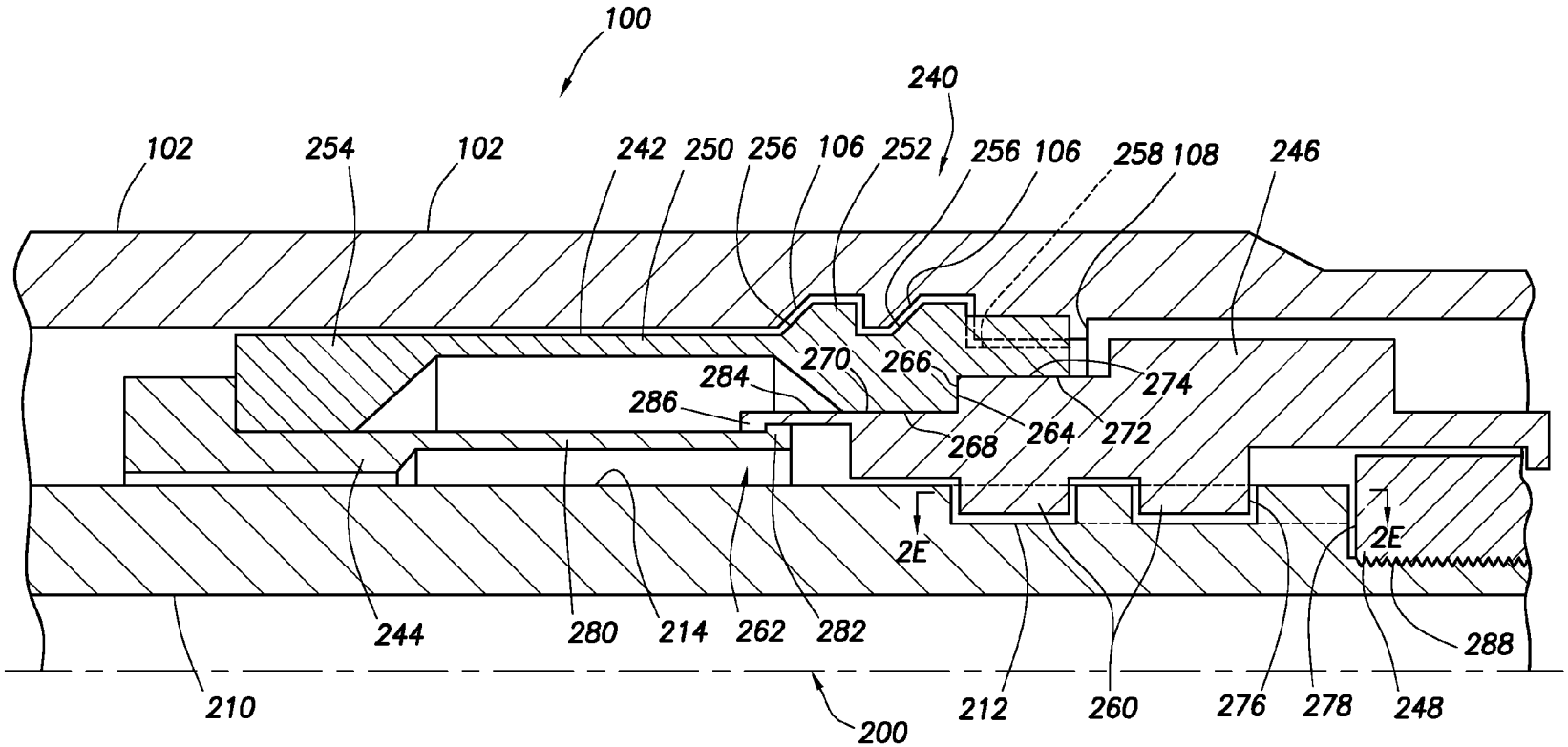
Figure 2C:
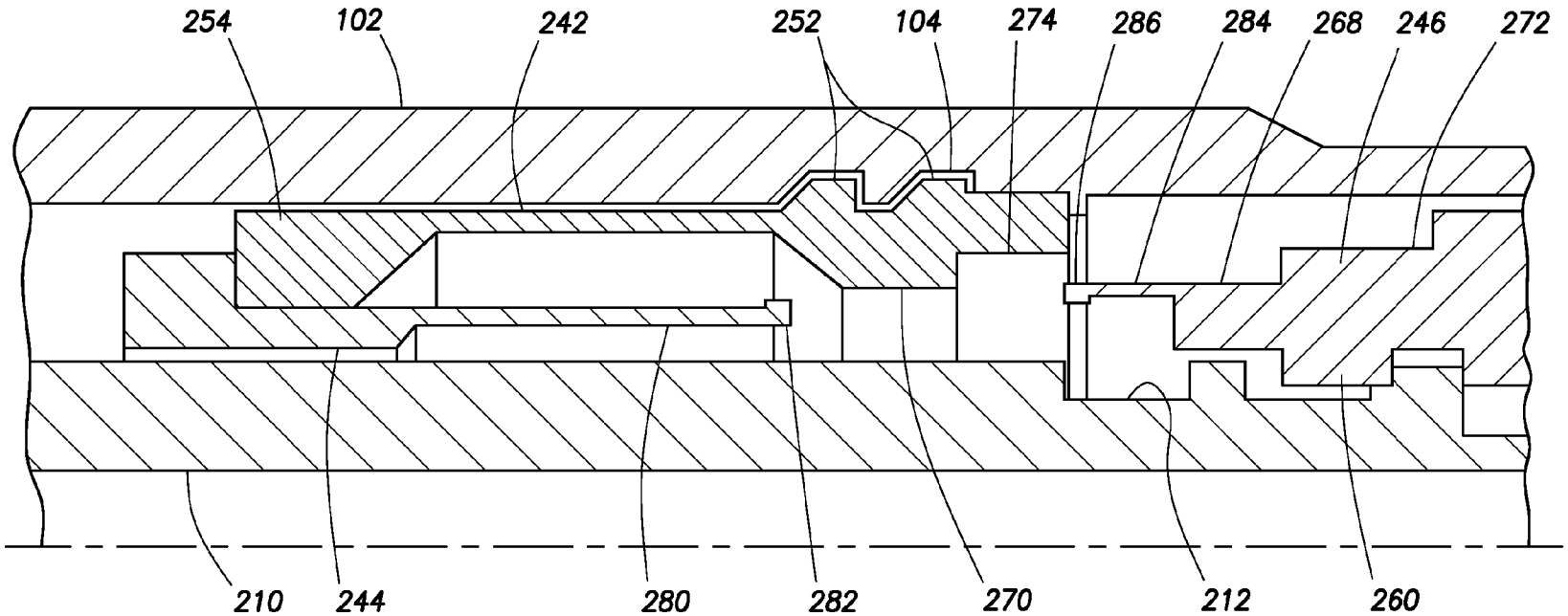
Figure 2D:
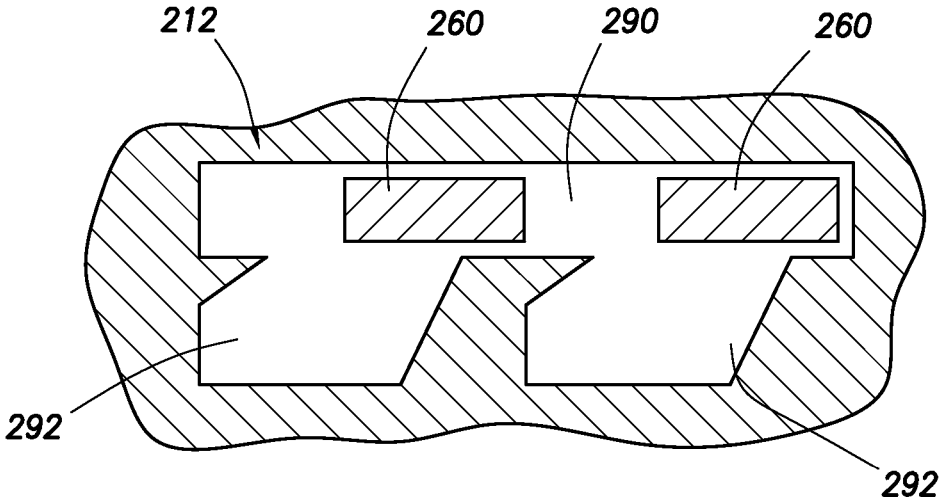
Figure 2E:
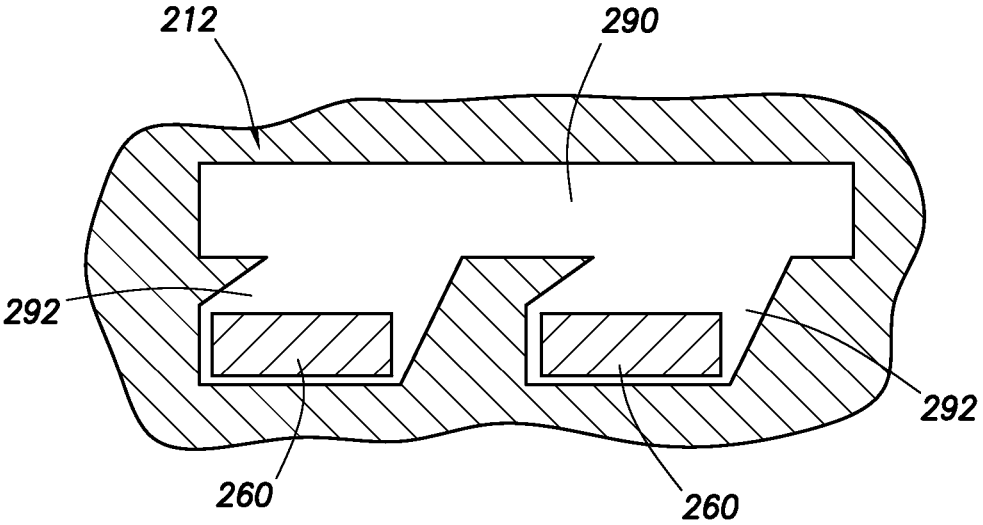
Figure 4A:
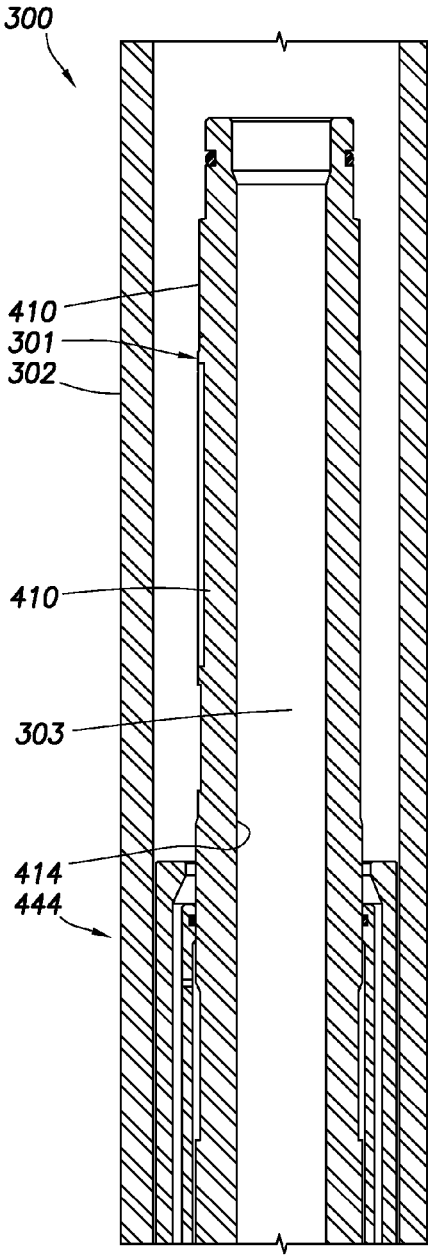
FIGS. 4A-D are longitudinal cross-section views of the preferred embodiment of the exemplary tool assembly of FIG. 3, seen in a compression loaded position according to an aspect of the invention.

FIGS. 2A-E are cross-sectional, partial schematic views of an embodiment of the J-slot and collet release features according to an aspect of the invention. FIG. 2A shows the tool assembly in a run-in position under tensile load. FIG. 2B shows the tool assembly in a weight-down and rotated mandrel position wherein the J-slot is engaged. FIG. 2C shows the tool assembly in a weight-down position wherein the release assembly is actuated. FIG. 2D is a longitudinal cross-section of the collet prop sleeve lugs and mandrel J-slot groove taken along line D-D of FIG. 2A. FIG. 2E is a longitudinal cross-section of the collet prop sleeve lugs and mandrel J-slot groove taken along line E-E of FIG. 2B. FIGS. 1 and 2 are discussed together.

A liner hanger tool string 100 is partially shown to illustrate the operation of the J-slot assembly. A liner hanger 102 is mounted on, or hung from, the tool assembly 200. Below the liner hanger 102 hangs a string of liners (not shown) as is known in the art. Hence, the weight of the liner hanger and liner string is placed on the collet assembly 240 of the tool assembly. The tool assembly includes an inner mandrel 210 having a J-slot profile 212 on its exterior surface 214. Further, the mandrel has recess 276 and shoulder 278 which cooperate with the prop nut 248 of the collet assembly.

The collet assembly 240 has a collet 242, a collet retainer 244, collet prop sleeve 246, and collet prop nut 248. The collet 242 includes a collet ring 254 from which a plurality of collet fingers 250 extend, the fingers having lugs 252 which cooperate with recesses 104 of the liner hanger. The load-bearing faces 256 of the collet fingers abut the load-bearing faces 106 of the liner hanger. Further, the liner hanger and collet assembly are locked rotationally, such that torque is transferred between them, since the interior surface of the liner hanger defines longitudinal splines 258 into which extend between the collet fingers or lugs 252. The collet is initially held in place by the radial support provided by the collet prop sleeve 246. When the collet prop sleeve drops, or slides longitudinally with respect to, the collet, the fingers flex radially inward, thereby releasing the collet from the liner hanger recesses and the tool assembly from the liner hanger.

The collet prop sleeve 246 slides longitudinally and rotationally with respect to the mandrel 210 as prop sleeve lugs 260 cooperate with the J-slot profile 212 on the mandrel. Multiple lug and groove assemblies can be used, spacing the lugs circumferentially along the interior surface of the collet prop sleeve 246. Further, as shown, multiple rows of lugs can be employed thereby reducing the torque load placed on any single lug. The prop sleeve has an upper shoulder 264 which opposes a lower shoulder 266 of the collet assembly, tensile load being transferred through the shoulders. The prop sleeve has longitudinally extending support surfaces 268 and 272 which are slidingly engaged with corresponding collet inner surfaces 270 and 274. These opposing surfaces maintain the collet fingers in a radially expanded position during run-in, weight-down and rotation during actuation of the lower mechanically actuated assembly (e.g., valve assembly), etc. The prop sleeve has a lower shoulder 276 through which tensile load is transferred to an opposed upper shoulder 278 on the prop nut 248.

The collet prop sleeve also has a releasable connection 262 to the retainer sleeve 244. The releasable connection can take many forms as are known in the art. In the preferred embodiment shown, the retainer sleeve includes a set of longitudinally extending fingers 280 with lugs 282 which cooperate with a retention sleeve 284 extending upwardly and having a lip 286 which cooperates with the finger lugs 282. The releasable connection 262 maintains the prop sleeve and collet retainer attached to one another until release is desired. The connection is pulled apart by applying weight-down on the mandrel to pull the fingers 280 from the cooperating sleeve 284. The prop nut 248 is threadedly attached to the mandrel 210 at 288. The prop nut bears tensile load transferred from the prop sleeve through faces 276 and 278.

As seen in FIG. 2D, the lugs 260 of the prop sleeve 246 are slidingly engaged in the J-slot 212 of the mandrel and in a run-in position, or tensile loaded position. The J-slot or profile 212 defined on the outer surface of the mandrel 210 includes a longitudinally extending slot 290 allowing the lugs 260 to slide longitudinally in response to weight-down on the tubing string. The profile 212 also includes a side pocket 292 allowing movement of the lugs rotationally with respect to the mandrel. Preferably the pockets are positioned for left-hand rotation of the lugs. In such a manner, this rotational movement to actuate a lower mechanical device cannot act to unintentionally unscrew or operate right-handed rotational elements, such as joint connections, etc. As seen in FIG. 2E, the lugs 260 are shown moved upwards longitudinally and rotationally into pockets 292. This position corresponds to the position of the tool assembly seen in FIG. 2B.

FIG. 2B shows the tool assembly in a position wherein the J-slot is engaged by the prop sleeve lugs after weight-down on the string and left-hand rotation. In this position, wherein the mechanically actuated lower mechanism 18 has been actuated, the mandrel 210 has moved longitudinally with respect to the liner hanger 102. Weight-down on the mandrel 210 moves the mandrel and collet prop nut 248 relatively downward. The prop sleeve 246, collet 242, collet retainer 244 and liner hanger 102 remain in a relatively stationary position as the mandrel, etc., are moved relatively downward. The collet lugs 252 remain engaged in the liner hanger recesses 104. The collet 242 abuts the collet prop sleeve and remains radially expanded (or not collapsed). The prop sleeve remains attached to the retainer 244 at connection 262. The prop sleeve lugs 260 are slid upward along the longitudinally extending slot 290 and have been rotated into the pockets 292. The mechanically actuated lower mechanism 18 has been actuated while the upper mechanism 16, the collet release assembly, remains in a locked position.

FIG. 2C shows the tool assembly with the collet release assembly actuated and the tool string in position to be pulled out of hole. The liner hanger 102, now hung, is detached from the collet 242 by again placing weight-down on the string. The compressive load on the collet assembly forces detachment at connection 262, with the fingers 280 pulled forcefully from the retaining sleeve 284. The prop sleeve 246, disengaged from the collet retainer and forced downward by the mandrel 210, moves longitudinally downward as shown. The radial support surface 268 no longer supports the collet, which is now free to collapse radially, thereby freeing the collet lugs 252 from the liner hanger recesses 104. The collet fingers can be biased to collapse radially inward or can simply be forced to collapse radially by sufficient upward pull resulting in sliding of the lugs at surfaces 256 across liner hanger recess surfaces 106. Pulling of the string moves the tool assembly out of the liner hanger and towards the surface. The tool can now be retrieved.

FIGS. 3A-D are longitudinal cross-section views of a preferred embodiment of an exemplary tool assembly in a run-in, or tensile loaded, position according to an aspect of the invention. FIGS. 4A-D are longitudinal cross-section views of the preferred embodiment of the exemplary tool assembly of FIG. 3, seen in a compression loaded position according to an aspect of the invention. FIGS. 5A-D are longitudinal cross-section views of the preferred embodiment of the exemplary tool assembly of FIG. 3, seen with the mechanically actuated lower mechanism in an actuated position according to an aspect of the invention. Namely, the valve assembly of the lower mechanism is open. FIGS. 6A-D are longitudinal cross-section views of the preferred embodiment of the exemplary tool assembly of FIG. 3, seen in a weight-down position having the mechanically actuated upper mechanism actuated. Namely, the collet release assembly has been released. Note that each of the FIGS. 3-6 are shown in cross-section, but modified such that the right side of each drawing is taken at a cross-section thirty degrees rotated from the cross-section on the left side of the Figures. This is done in order to show additional features of the mechanisms which would otherwise not appear in the Figures.

Figure 3A:
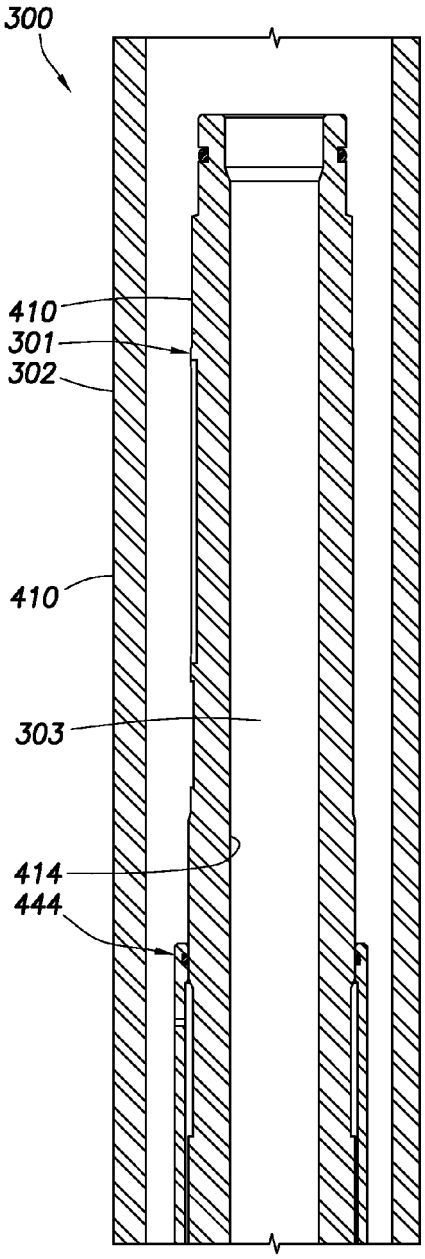
FIGS. 3A-D are longitudinal cross-section views of a preferred embodiment of an exemplary tool assembly in a run-in, or tensile loaded, position according to an aspect of the invention.
Figure 3B:
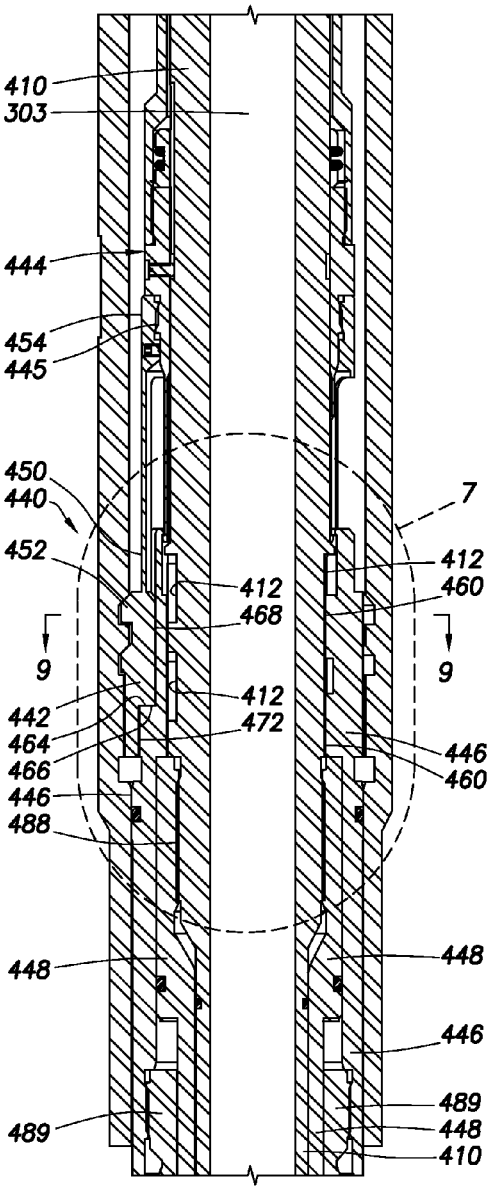
Figure 4B:
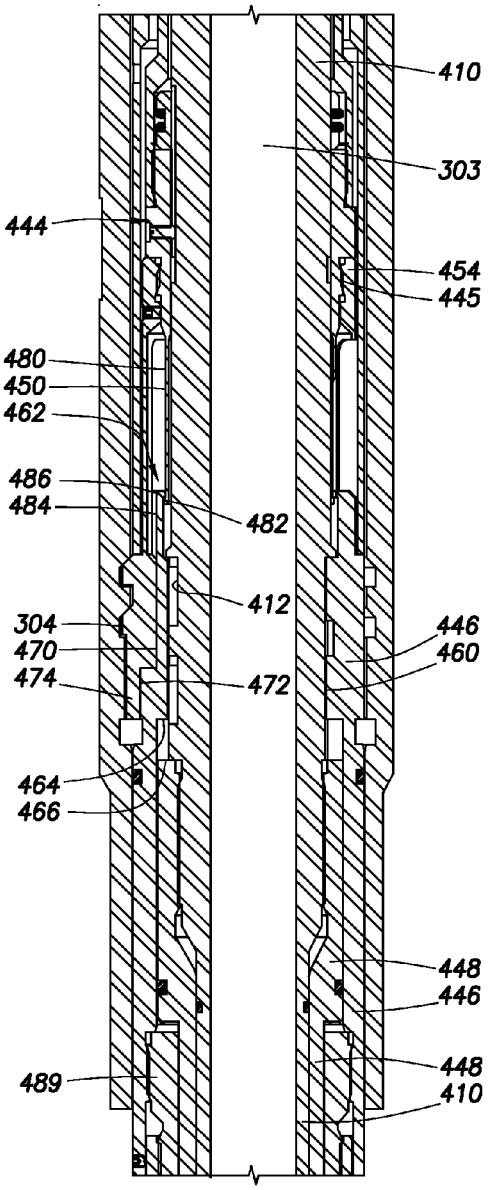
Figure 3C:
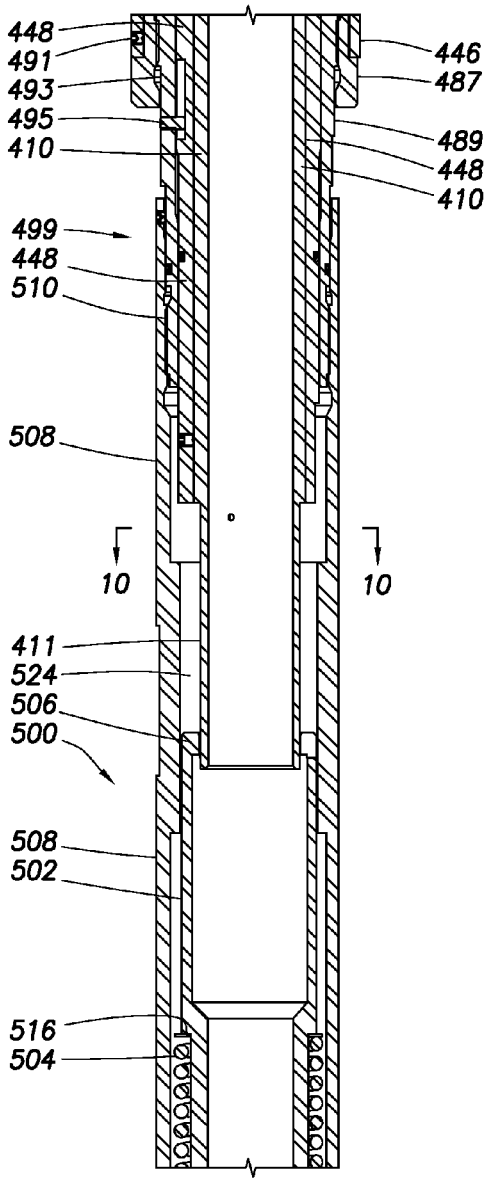
Figure 4C:
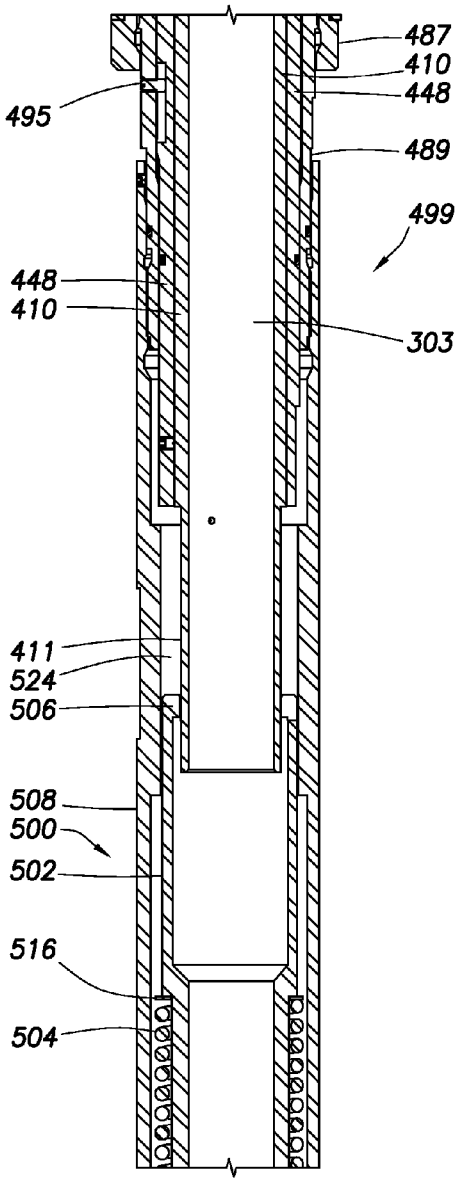
Figure 7:
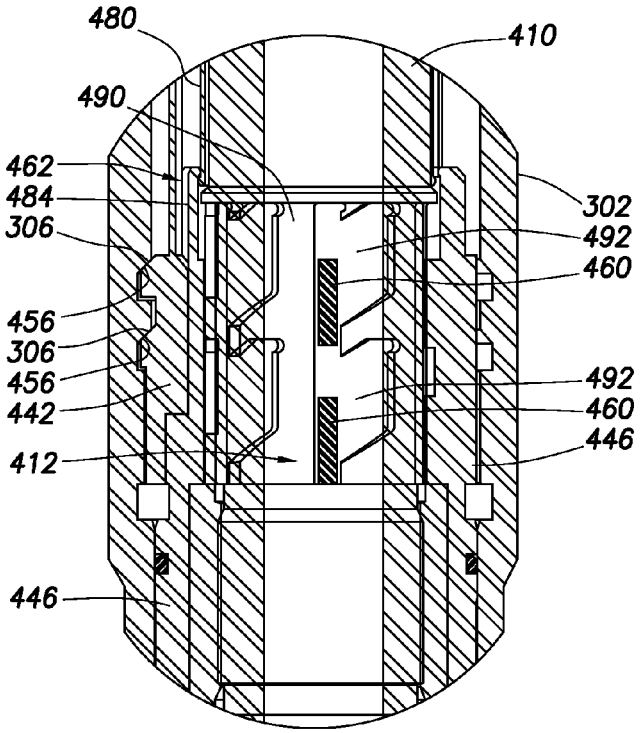
FIG. 7 is a cross-sectional detail taken from FIG. 3B and is of a preferred embodiment of an exemplary tool assembly in a run-in, or tensile loaded, position according to an aspect of the invention.
Figure 8:
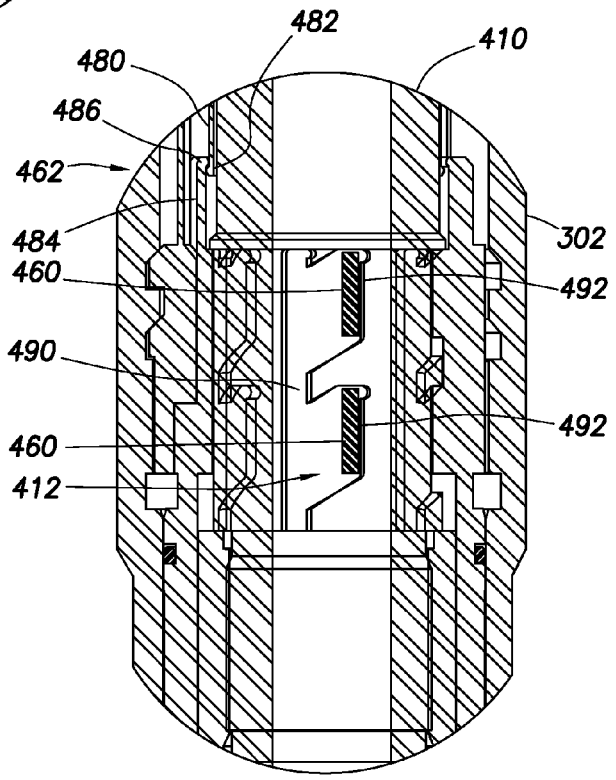
FIG. 8 is a cross-sectional detail view taken as indicated from FIG. 5B of the tool assembly having a lower mechanically actuated mechanism actuated.

FIG. 7 is a cross-sectional detail taken as indicated from FIG. 3B and is of a preferred embodiment of an exemplary tool assembly in a run-in, or tensile loaded, position according to an aspect of the invention. FIG. 8 is a cross-sectional detail view taken as indicated from FIG. 5B of the tool assembly having a lower mechanically actuated mechanism actuated. FIGS. 9-12 are cross-section views of the preferred embodiment of FIGS. 3-6 taken at the correspondingly numbered lines. Many of the details of the Figures are not discussed as they will be apparent to the practitioner of the art, known in the industry or a matter of design choice. The Figures are discussed together. Many of the details of the Figures are not discussed as they will be apparent to the practitioner of the art, known in the industry or a matter of design choice.

A liner hanger tool string 300 is shown having a tool 301 with a liner hanger 302 mounted thereon and having an upper mechanically operated mechanism, namely a collet release assembly 440, and a lower mechanically operated mechanism, namely, a sleeve operated valve assembly 500. The upper end of the tool 301 connects to further sections of a tool string (not shown) as known in the art. The tool assembly defines an interior passageway 303.

Below the liner hanger 302 hangs a string of liners (not shown) as is known in the art. The weight of the liner hanger and liner string is placed on the collet assembly 440 of the tool assembly. The tool assembly includes an inner mandrel 410 having a J-slot profile 412 on its exterior surface 414. Further, the interior surface of the mandrel has a recess 416 and shoulder 418 which cooperate with the prop nut 448 of the collet assembly.

The collet assembly 440 has a collet 442, a collet retainer assembly 444, collet prop sleeve assembly 446, and collet prop nut assembly 448. The collet 442 includes a collet ring 454 from which a plurality of collet fingers 450 extend, the fingers having lugs 452 which cooperate with recesses 304 of the liner hanger. The load-bearing faces 456 of the collet fingers contact the load-bearing faces 306 of the liner hanger. Further, the liner hanger and collet assembly are locked rotationally, such that torque is transferred between them, since the interior surface of the liner hanger defines longitudinal splines 458 into which extend between the collet fingers or lugs 452. The collet is initially held in place by the radial support provided by the collet prop sleeve 446. When the collet prop sleeve drops, or slides longitudinally with respect to, the collet, the fingers flex radially inward, thereby releasing the collet from the liner hanger recesses and the tool assembly from the liner hanger.

The collet prop sleeve 446 slides longitudinally and rotationally with respect to the mandrel 410 as lugs 460 cooperate with the J-slot profile 412 on the mandrel. Multiple lug and groove assemblies can be used, spacing the lugs circumferentially along the interior surface of the collet prop sleeve 446. Further, as shown, multiple rows of lugs can be employed thereby reducing the torque load placed on any single lug. The prop sleeve has an upper shoulder 464 which opposes a lower shoulder 466 of the collet assembly, tensile load being transferred through the shoulders. The prop sleeve has longitudinally extending support surfaces 468 and 472 which are slidingly engaged with corresponding collet inner surfaces 470 and 474. These opposing surfaces maintain the collet fingers in a radially expanded position during run-in, weight-down and rotation during actuation of the lower mechanically actuated assembly (e.g., valve assembly), etc. The prop sleeve has a lower shoulder 476 through which tensile load is transferred to an opposed upper shoulder 478 on the prop nut 448.

The collet prop sleeve also has a releasable connection 462 to the retainer sleeve 444. The releasable connection can take many forms as are known in the art. In the preferred embodiment shown, the retainer sleeve assembly 444 includes a set of longitudinally extending fingers 480 with lugs 482 which cooperate with a retention sleeve 484 extending from the upper end of the prop sleeve 446. An annular lip 486 defined in the upper rim of the retention sleeve cooperates with the finger lugs 482. The releasable connection 462 maintains the prop sleeve and collet retainer attached to one another until release is desired. The connection is pulled apart by applying weight-down on the mandrel to pull the fingers 480 from the cooperating retention sleeve 484. The prop nut 448 is threadedly attached to the mandrel 410 at 488. The prop nut bears tensile load transferred from the prop sleeve through faces 476 and 478. Tensile load is transferred to the mandrel via the threaded connection or other means.

The retainer sleeve assembly 444 can be made-up of multiple parts, as shown. The sleeve 444 slidingly engages the mandrel. In the embodiment shown, the sleeve assembly is made-up of multiple annular or tubular members, connected by threads, annular nuts, etc. The lower end of the retainer sleeve is attached at 445 to the upper end of the collet ring 454 by threads, screw, pin, etc. The collet and retainer sleeve remain attached to one another through all steps of tool use downhole and, collectively, when not attached to the prop sleeve at attachment 462, are free to float or slide up and down with respect to the mandrel. A pin 457 slides within a corresponding longitudinal groove 459 defined on the exterior of the mandrel.

The lugs 460 of the prop sleeve 446 are slidingly engaged in the J-slot 412 of the mandrel and in a run-in position, or tensile loaded position. The J-slot or profile 412 defined on the outer surface of the mandrel 410 includes a longitudinally extending slot 490 allowing the lugs 460 to slide longitudinally in response to weight-down on the tubing string. The profile 412 also includes a side pocket 492 allowing movement of the lugs rotationally with respect to the mandrel. Preferably the pockets are positioned for left-hand rotation of the lugs. In such a manner, this rotational movement to actuate a lower mechanical device cannot act to unintentionally unscrew or operate right-handed rotational elements, such as joint connections, etc. As seen in FIG. 7, the lugs 460 are shown bottomed out in the slot 490. At FIG. 8, the lugs are seen moved relatively upwardly and left-hand rotated about a quarter turn such that the lugs 460 are now positioned in pockets 492 of the J-slot. (Note that the mandrel and J-slot is preferably moved down and rotated while the lugs remain basically stationary. The movement is relative.)

An adjustment sleeve assembly 499, which is not explained in detail herein, attaches the prop sleeve 446, via connector or nut 487 and pin or screw 491, to the adjustment sleeve 489. The sleeve 489 has an inwardly extending pin 495 which cooperates slidingly with a longitudinal groove 493 in the exterior surface of the prop nut 448 allowing limited relative longitudinal movement. The adjustment sleeve 489, in turn, is attached to the valve assembly housing 508 at connection 510.

Figure 3D:
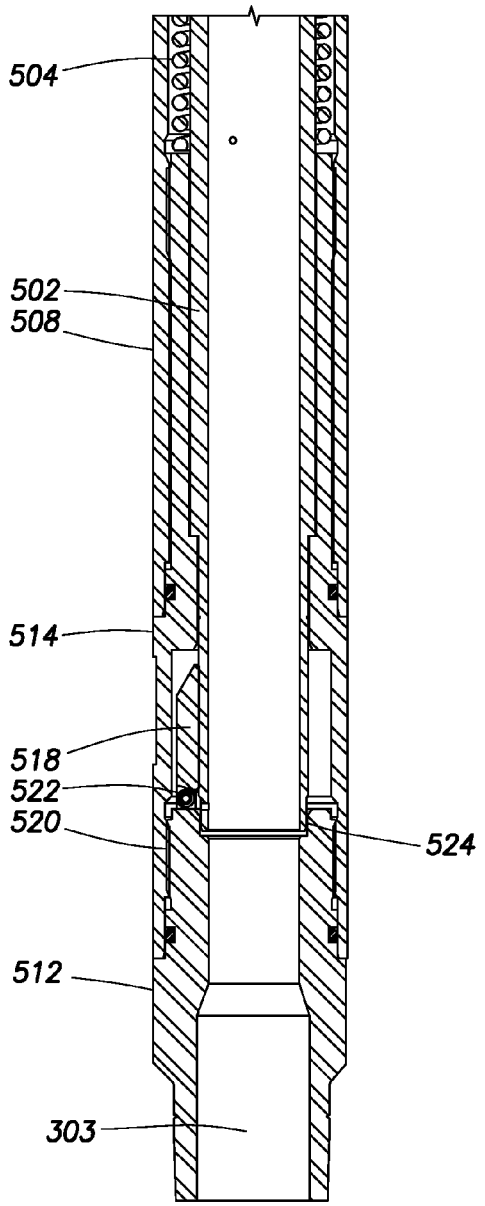
Figure 4D:
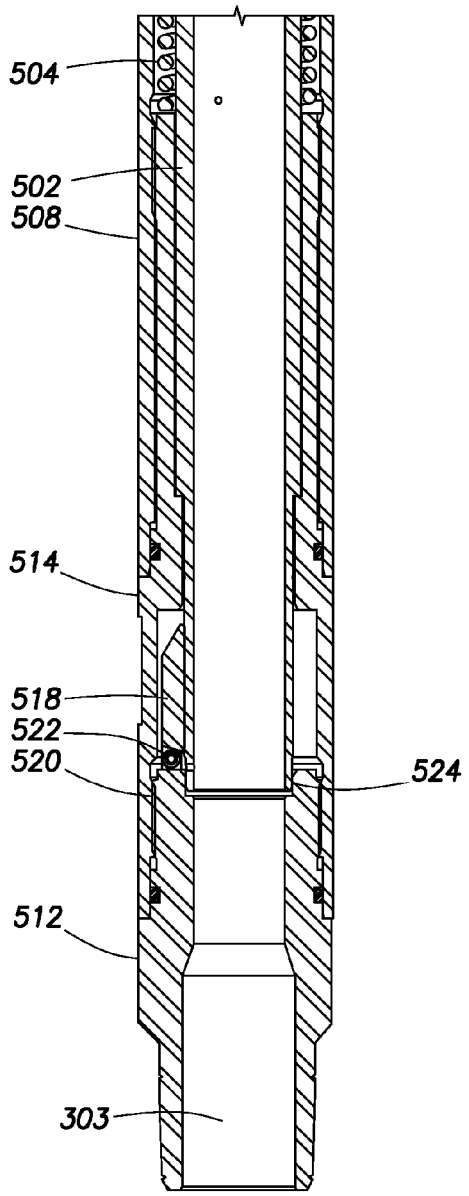
Figure 5A:
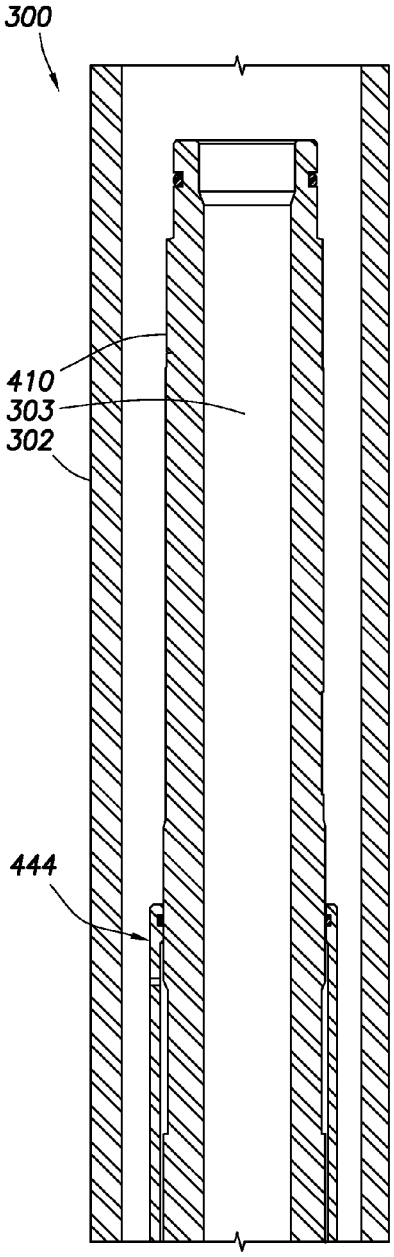
FIGS. 5A-D are longitudinal cross-section views of the preferred embodiment of the exemplary tool assembly of FIG. 3, seen with the mechanically actuated lower mechanism in an actuated position according to an aspect of the invention.
Figure 6A:
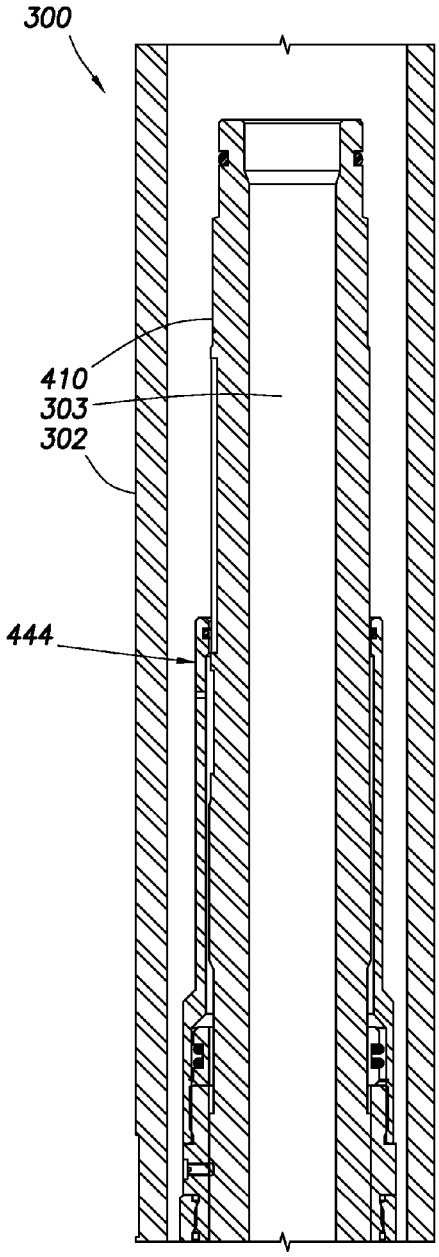
FIGS. 6A-D are longitudinal cross-section views of the preferred embodiment of the exemplary tool assembly of FIG. 3, seen in a weight-down position having the mechanically actuated upper mechanism actuated.
Figure 5B:
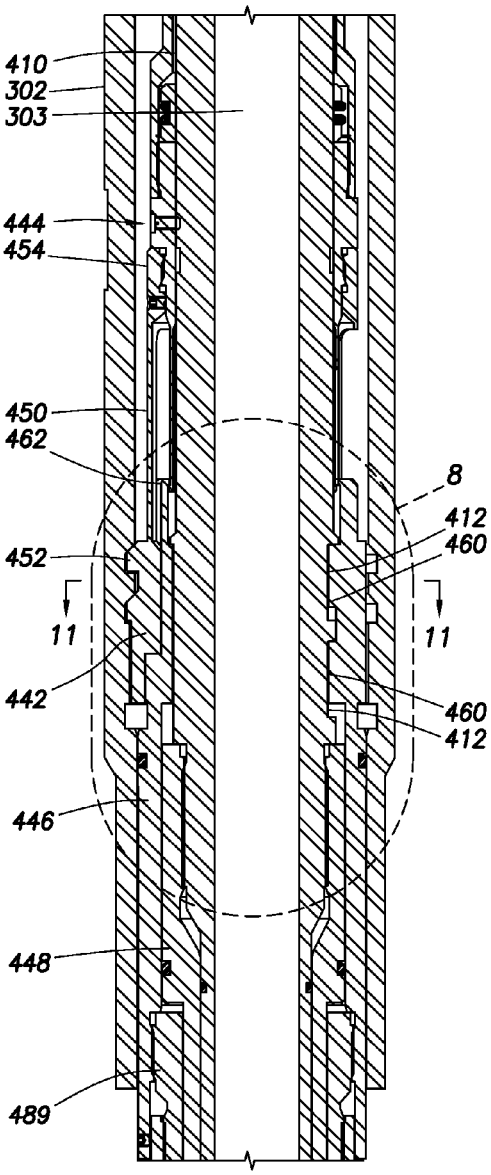
Figure 6B:
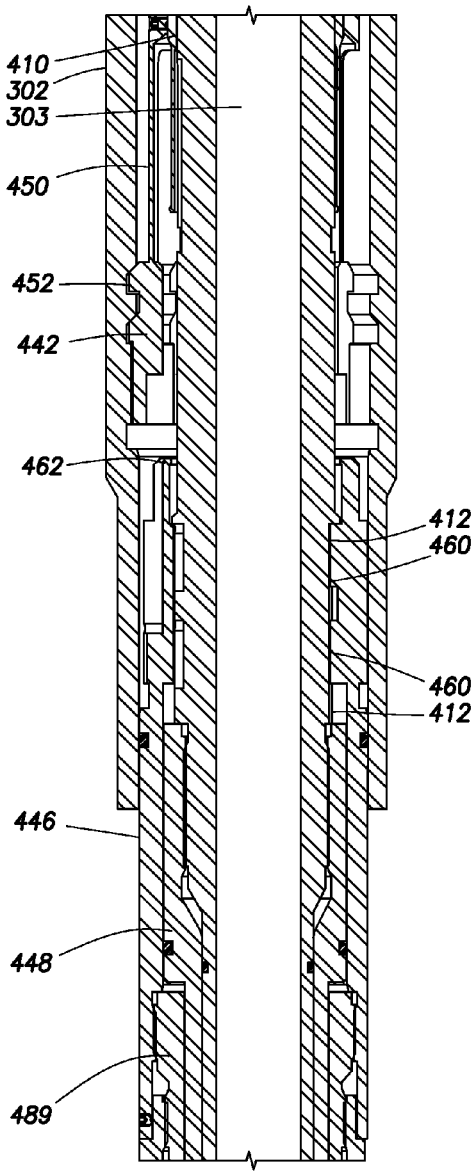
Figure 5C:
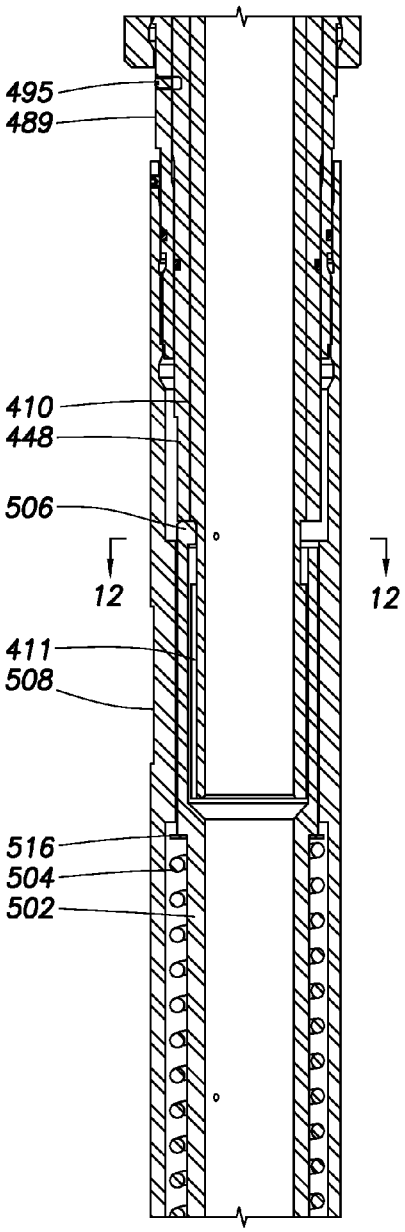
Figure 6C:
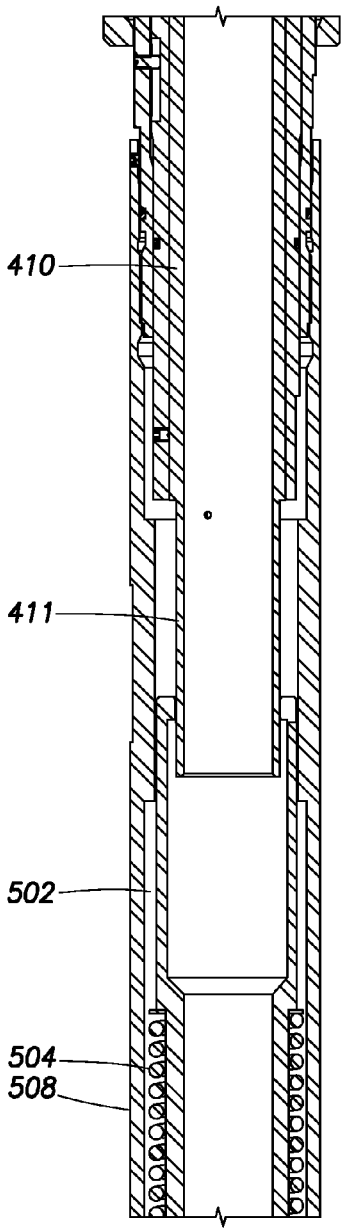
Figure 5D:
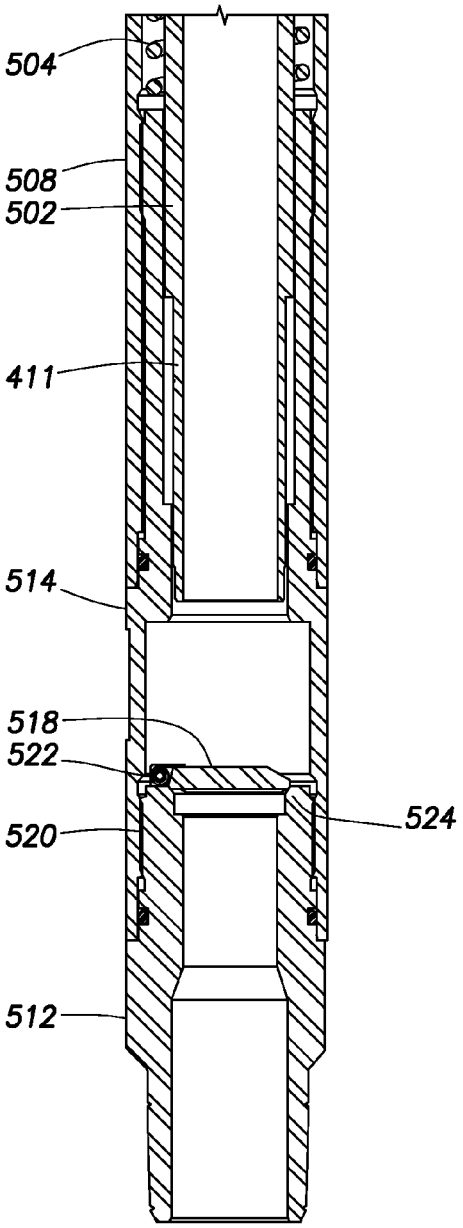
Figure 6D:
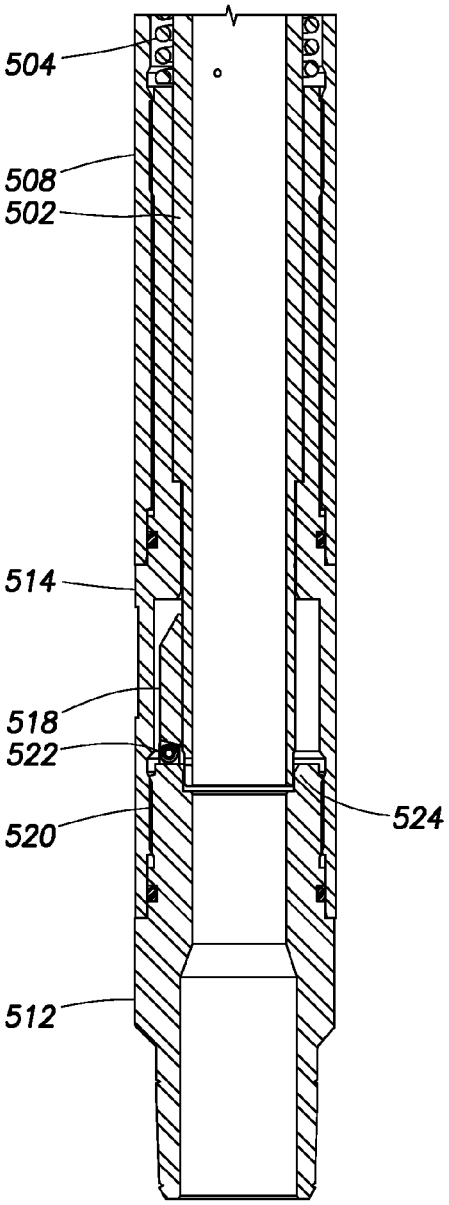

The mechanically actuated lower mechanism 500, in this case a flapper valve assembly, includes a housing 508. Between the housing 508 and a valve sleeve 502 is positioned a biasing element 504, here a spring. The spring biases the valve sleeve 502 upward and is compressed at run-in. The spring is seated on a valve element sleeve 514 and acts upwardly on shoulder 516 on the exterior of the valve sleeve 502. The valve element sleeve 514 defines a recess to house the valve element 518 when the valve is in an open position, as seen in FIG. 3D. A bottom valve seat sub 512 attaches to the valve element sleeve 514 at connection 520. The tool passageway 303 continues to be defined within the tool assembly along bottom sub, valve sleeve, etc., as shown. A valve element biasing mechanism 522, here a spring, biases the valve element to a closed position, as seen in FIG. 5D. The valve element, when closed seals against seat 524.

Figure 10:
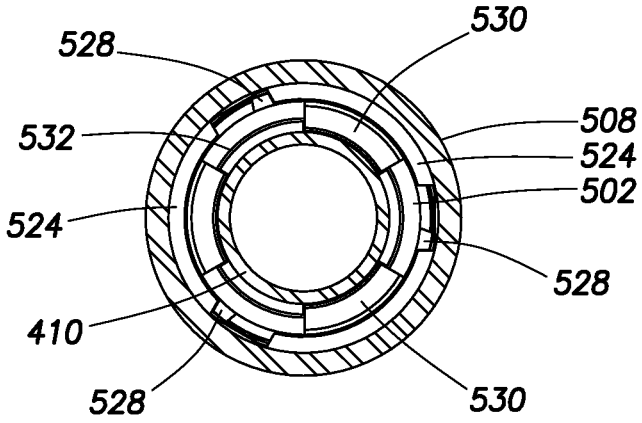

The lower end 411 of the mandrel 410 is slidably engaged within the upper end of the valve sleeve 502. As best seen at FIG. 10, a cross-section taken at line 10-10 of FIG. 3C, the valve housing 508 has radially inwardly extending, circumferentially spaced, internal splines 526 which cooperate with corresponding external lugs 528 on the exterior surface of the valve sleeve 502. As seen in FIG. 10, in an initial position, the external lugs 528 are partially under the splines 526, thereby preventing the lugs from sliding upward between the splines, and preventing the valve sleeve from sliding upward. Similarly, internal lugs 530 on the valve sleeve 502 cooperate with external splines 532 on the lower end of the mandrel 410. After run-in, when weight-down is placed on the tool, the mandrel drops in relation to the valve sleeve by an incremental amount. The mandrel is turned, preferably one-quarter left-hand turn. The external splines 532 of the mandrel cooperate with the internal lugs of the valve sleeve, thereby forcing the valve sleeve to turn. As the valve sleeve is turned, the external lugs 528 of the valve sleeve align between the internal splines 526 of the housing. The valve sleeve is free to move longitudinally with respect to the valve housing and the biasing spring 504 forces the sleeve upward to an actuated position as seen in FIGS. 5C-D. The sleeve clears the valve element 518 and the biasing spring 522 force the valve element to a closed position with the valve element seated against valve seat 524 as seen in FIG. 5D. Tubing fluid can now be pumped against the valve, raising internal pressure, to actuate various downhole tools.

FIG. 4 shows the tool after run-in and with weight-down on the string. The mandrel has moved longitudinally with respect to the collet assembly. And the mandrel is ready for a left-hand turn to rotate the valve sleeve. FIG. 5 shows the tool assembly after a quarter rotation. The mechanically operated lower mechanism, namely the valve assembly, is actuated, closing the valve. Obviously, other types of valves can be employed and other types of mechanically operated assemblies can be actuated. FIG. 6 shows the tool assembly released from the liner hanger. Weight has been placed down again on the string and the elements of the collet assembly pulled apart as described above herein. The collet, pulled free from the liner hanger, the tool assembly and string are then pulled from the wellbore.

FIG. 5 shows the tool assembly in a position wherein the J-slot is engaged by the prop sleeve lugs after weight-down on the string and left-hand rotation. In this position, wherein the mechanically actuated lower mechanism 500 is actuated, the mandrel 410 has moved longitudinally with respect to the liner hanger 302. Weight-down on the mandrel 410 moves the mandrel and collet prop nut 448 relatively downward. The prop sleeve 446, collet 442, collet retainer 444 and liner hanger 302 move relatively upward. The collet lugs 452 remain engaged in the liner hanger recesses 304. The collet 442 abuts the collet prop sleeve and remains radially expanded (or not collapsed). The prop sleeve remains attached to the retainer 444 at connection 462. The prop sleeve lugs 460 are slid upward along the longitudinally extending slot 490 and have been rotated into the pockets 492. (Or, the mandrel J-slot is moved longitudinally downward and rotated to engage the lugs 460 in the J-slot pockets 492.) The mechanically actuated lower mechanism 500 has been actuated while the upper mechanism 440, the collet release assembly, remains in a locked position.

FIG. 6 shows the tool assembly with the collet release assembly actuated and the tool string in position to be pulled out of hole. The liner hanger 302, now hung, is detached from the collet 242 by again placing weight-down on the string. The compressive load on the collet assembly forces detachment at connection 462, with the fingers 480 pulled forcefully from the retaining sleeve 484. The prop sleeve 446, disengaged from the collet retainer and forced downward by the mandrel 410, moves longitudinally downward as shown. The radial support surface 468 no longer supports the collet, which is now free to collapse radially, thereby freeing the collet lugs 452 from the liner hanger recesses 304. The collet fingers can be biased to collapse radially inward or can simply be forced to collapse radially by sufficient upward force resulting in sliding of the lugs at surfaces 456 across liner hanger recess surfaces 306. Pulling of the string moves the tool assembly out of the liner hanger and towards the surface. The tool can now be retrieved.

FIG. 6 shows the valve assembly in a closed position. The collet assembly can be actuated, and the tool released from the liner hanger, etc., either before or after actuation of the valve. Where the valve element is closed before release of the tool, the valve remains closed during pull-out, in a preferred embodiment. Where the tool is released from the liner hanger without prior actuation of the valve assembly, the valve remains open during pull-out, as seen in FIG. 6.

Figure 9:
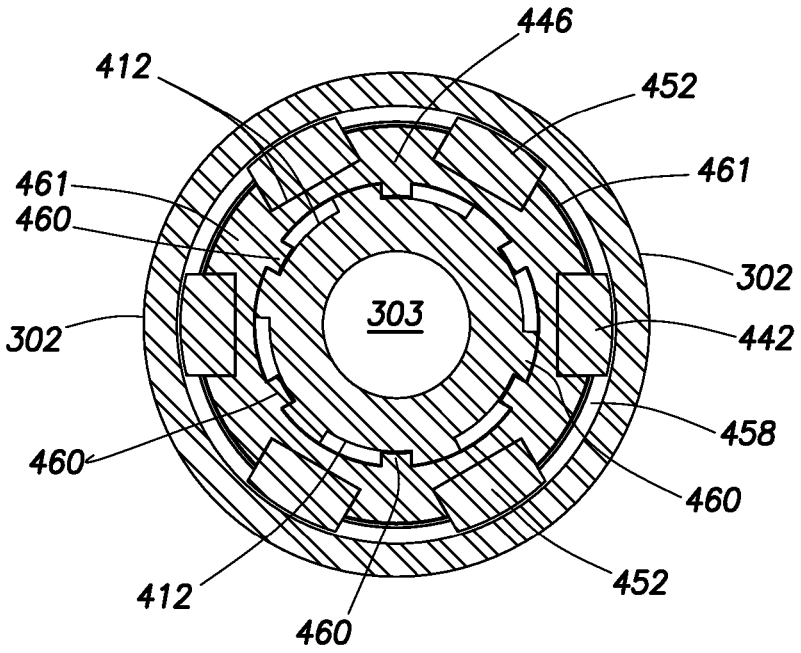
FIGS. 9-12 are cross-section views of the preferred embodiment of FIGS. 3-6 taken at the correspondingly numbered lines.
Figure 11:
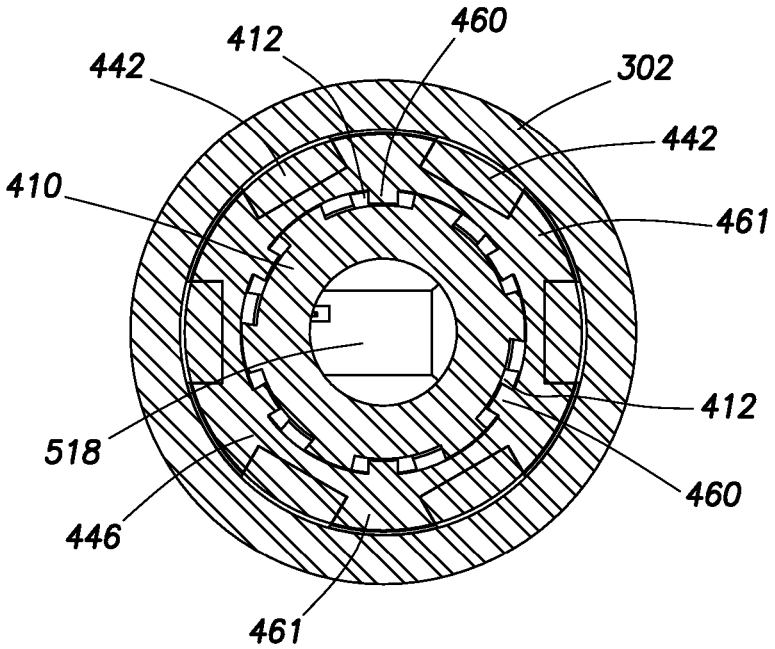
Figure 12:
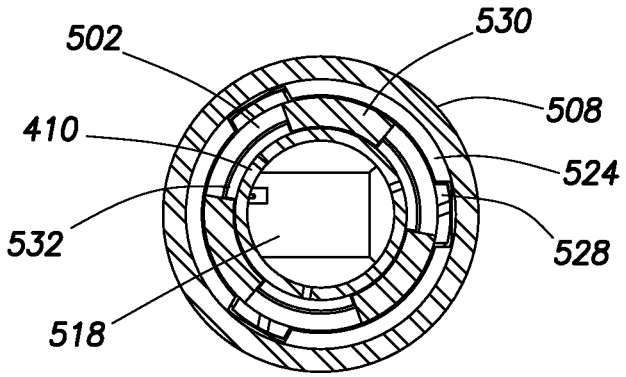

FIG. 9 is a cross-sectional view taken along line 9-9 in FIG. 3B. The liner hanger 302 has longitudinal splines 458 into which extend between the lugs 452 of the collet fingers 442, thereby limiting axial movement of the collet. The external splines 461 on the prop sleeve 246 cooperate with the collet lugs 452. Finally, the J-slot profile 412 is seen defined on the external surface of the mandrel 410 with the prop sleeve lugs 460 cooperating therein. FIG. 11 is a cross-sectional view taken along line 11-11 in FIG. 5B. Mandrel 410 has J-slot profile 412 with prop sleeve internal lugs 460 rotated to a new position. Prop sleeve external lugs 461 are positioned between collet lugs 442. The now-closed valve element 518 is seen through the interior passageway. FIG. 12 is a cross-sectional view taken along line 12-12 in FIG. 5C. The lower mechanically operated mechanism has been actuated. Internal lugs 530 on the valve sleeve 502 cooperate with external splines 532 on the lower end of the mandrel 410. Weight has been placed down on the tool and the mandrel has dropped in relation to the valve sleeve. The mandrel has been turned, one-quarter left-hand turn. The external splines 532 of the mandrel, which cooperate with the internal lugs of the valve sleeve, force the valve sleeve to turn as the mandrel turns. Now that the valve sleeve has turned, external lugs 528 of the valve sleeve align between the internal splines 526 of the housing. The valve sleeve has moved longitudinally with respect to the valve housing and the biasing spring 504 has forced the sleeve upward to the actuated position, as also seen in FIGS. 5C-D. The sleeve has cleared the valve element 518 and the biasing spring 522 force the valve element to a closed position.

The tool can be used in conjunction with actuating, expansion or other assemblies, such as hydraulically actuated pistons for performing additional downhole functions such as expanding an expandable liner hanger. For further disclosure regarding installation of a liner string in a wellbore casing, see U.S. Patent Application Publication No. 2011/0132622, to Moeller, which is incorporated herein by reference for all purposes. For further disclosure regarding cementing procedures and tools, see the other references incorporated herein. For disclosure regarding expansion cone assemblies and their function, see U.S. Pat. No. 7,779,910, to Watson, which is incorporated herein by reference for all purposes. For further disclosure regarding hydraulic set liner hangers, see U.S. Pat. No. 6,318,472, to Rogers, which is incorporated herein by reference for all purposes. Also see PCT Application No. PCT/US12/58242, to Stautzenberger, which is incorporated herein by reference in its entirety for all purposes.

In preferred embodiments, the following methods are disclosed; the steps are not exclusive and can be combined in various ways. A method of performing an oilfield operation in a subterranean wellbore extending through a hydrocarbon-bearing zone, the method comprising the following steps: a. running-in a tool string, an upper and a lower mechanically operated tool assemblies positioned on the tool string, a carried tool releasably attached to the tool string; b. actuating the lower mechanically operated tool assembly by manipulation of the tool string; and thereafter c. actuating the upper mechanically operated tool assembly by further manipulation of the tool string. Further steps and limitations can include, in various orders: wherein step a. further comprises releasably attaching a liner hanger to a release assembly; wherein the manipulation in step b. further comprises placing weight-down on the tool string and rotating the tool string; wherein the manipulation of step b. further comprises rotating the tool string in a left-handed direction; wherein the manipulation in step b. further comprises placing weight-down on the tool string before rotating the tool string; wherein placing weight-down longitudinally moves cooperating lugs along a J-slot profile of the upper mechanically operated tool assembly; wherein the J-slot profile is defined on the exterior surface of a tool mandrel; wherein the cooperating lugs extend from a collet release assembly into the J-slot profile; wherein rotation of the tool string actuates the lower mechanically operated tool assembly; wherein rotation of the tool string causes relative longitudinal movement of a moveable member of the lower mechanically operated tool assembly; wherein the moveable member is a sliding sleeve; wherein the sliding sleeve is biased to move by a biasing mechanism; further comprising the steps of moving the sliding sleeve and, in response thereto, closing a valve element; wherein the manipulation in step c. further comprises placing weight-down on the tool string; further comprising a step of performing an operational task on the wellbore between steps b. and c; wherein the operational task includes pumping fluid through the tool string.

Exemplary methods of use of the invention are described, with the understanding that the invention is determined and limited only by the claims. Those of skill in the art will recognize additional steps, different order of steps, and that not all steps need be performed to practice the inventive methods described.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

It is claimed:

1. A method of performing an oilfield operation in a subterranean wellbore extending through a hydrocarbon-bearing zone, the method comprising the following steps:

a. running-in a tool string, an upper and a lower mechanically operated tool assemblies positioned on the tool string, a carried tool releasably attached to the tool string;

b. actuating the lower mechanically operated tool assembly by manipulation of the tool string; by placing weight-down on the tool string and rotating the tool string; and thereafter c. actuating the upper mechanically operated tool assembly by further manipulation of the tool string.

2. The method of claim 1, wherein step a. further comprises releasably attaching a liner hanger to a release assembly.

3. The method of claim 1, wherein the manipulation in step b. further comprises rotating the tool string in a left-handed direction.

4. The method of claim 1, wherein the manipulation in step b. further comprises placing weight-down on the tool string before rotating the tool string.

5. The method of claim 4, wherein placing weight-down longitudinally moves cooperating lugs along a J-slot profile of the upper mechanically operated tool assembly.

6. The method of claim 5, wherein the J-slot profile is defined on the exterior surface of a tool mandrel.

7. The method of claim 6, wherein the cooperating lugs extend from a collet release assembly into the J-slot profile.

8. The method of claim 1, wherein rotation of the tool string actuates the lower mechanically operated tool assembly.

9. The method of claim 8, wherein rotation of the tool string causes relative longitudinal movement of a moveable member of the lower mechanically operated tool assembly.

10. The method of claim 9, wherein the moveable member is a sliding sleeve.

11. The method of claim 10, wherein the sliding sleeve is biased to move by a biasing mechanism.

12. The method of claim 10, further comprising the steps of moving the sliding sleeve and, in response thereto, closing a valve element.

13. The method of claim 1, wherein the manipulation in step c. further comprises placing weight-down on the tool string.

14. The method of claim 1, further comprising a step of performing an operational task on the wellbore between steps b. and c.

15. The method of claim 14, wherein the operational task includes pumping fluid through the tool string.

* * * * *